United States Patent [19]

Anderson et al.

[11] 4,424,654

[45] Jan. 10, 1984

[54] PANEL RIGIDIZER

[75] Inventors: William C. Anderson, Cascade; Richard H. Wolters, Grand Rapids Township, Kent County, both of Mich.

[73] Assignee: Westinghouse Electric Corp., Pittsburgh, Pa.

[21] Appl. No.: 291,742

[22] Filed: Aug. 11, 1981

[51] Int. Cl.[3] ..... E04H 3/00

[52] U.S. Cl. ..... 52/239; 52/761; 52/282; 52/270

[58] Field of Search ..... 52/239, 282, 270, 285, 52/761; 160/135, 351

[56] References Cited

U.S. PATENT DOCUMENTS

| | | | |
|---|---|---|---|
| 3,261,625 | 7/1966 | Cripe | 52/239 |
| 3,895,670 | 7/1975 | Bales | 160/135 |
| 3,971,182 | 7/1976 | Donahue | 160/135 |
| 4,104,838 | 8/1978 | Hage | 160/135 |
| 4,129,163 | 12/1978 | Johnson | 160/135 |
| 4,250,676 | 2/1981 | Presby | 160/135 |

*Primary Examiner*—Henry E. Raduazo

*Attorney, Agent, or Firm*—B. R. Studebaker

[57] ABSTRACT

A panel rigidizer for maintaining linear alignment of a plurality of space dividing wall panels interconnected by cylindrical support posts. The panel rigidizer spans the interconnection of a pair of wall panels and associated connecting post and includes a pair of linearly aligned leg portions which are secured to the top edge of the wall panels and a central hub portion which overlies the cylindrical post and receives therethrough the post cap.

3 Claims, 3 Drawing Figures

PANEL RIGIDIZER

BACKGROUND OF THE INVENTION

This invention relates to space dividing wall panel systems of the type employed in "open plan" offices and is more particularly directed to a panel rigidizer which may be used to span the intersection of pairs of space dividing wall panels and which is particularly useful when a series of space dividing wall panels are linearly aligned as for example in forming a corridor wall.

A successful space dividing wall panel system is disclosed in U.S. Pat. No. 3,762,116 to William C. Anderson et al. for Space Divider System And Connector Assembly Therefor. In this system space dividing wall panels are connected together and supported by a cylindrical post which provides great versatility with respect to developing an office system wherein the wall panels may be disposed in almost any angular relationship with respect to each other. Since there are no fixed points of attachment of the wall panels to the cylindrical post, linear alignment of a long run of space dividing wall panels can acquire a slight wave effect if the panels on each side of the intermediate support posts are not precisely aligned. Additionally, jostling of a wall panel can cause a slight departure from the original precise alignment and again create the appearance of a wave effect.

In instances where it is contemplated that a long, multiple panel, linear association will be employed, a means is required to assure linear alignment of adjacent panels which will not detract from the panel appearance nor have an appearance which is significantly different from the interconnection of panels that need not be rigidized.

SUMMARY OF THE INVENTION

The panel rigidizer of this invention provides for precise linear alignment of an elongated series of linearly aligned space dividing wall panels without detracting from the appearance of the rigidized connections with respect to connections in the wall panel system which need not be rigidized while providing relatively simple disassembly of the rigidized connections when it is desired to reassemble the space dividing wall panels in a different office configuration. The foregoing is provided in a space dividing wall panel system which includes at least first and second space dividing wall panels having connector means at each end thereof and a tubular post constructed and arranged to interconnect and support the first and second wall panels through said connector means and in which the tubular post has a central aperture in the top end thereof by providing; rigidizing means including a pair of linearly aligned leg portions and a hub portion therebetween, the hub portion includes an aperture therethrough and means are provided for securing one of the leg portions to the top edge of the first wall panel and the other of the leg portions to the top edge of the second wall panel whereby the aperture in the hub portion overlies the threaded aperture in the tubular post. Cap means are provided which extend through the aperture in the hub portion of the rigidizing means and is threadably received in the threaded aperture in the tubular post. The means employed for securing the leg portions of the panel rigidizer to the top edge of the wall panels is preferably screws.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
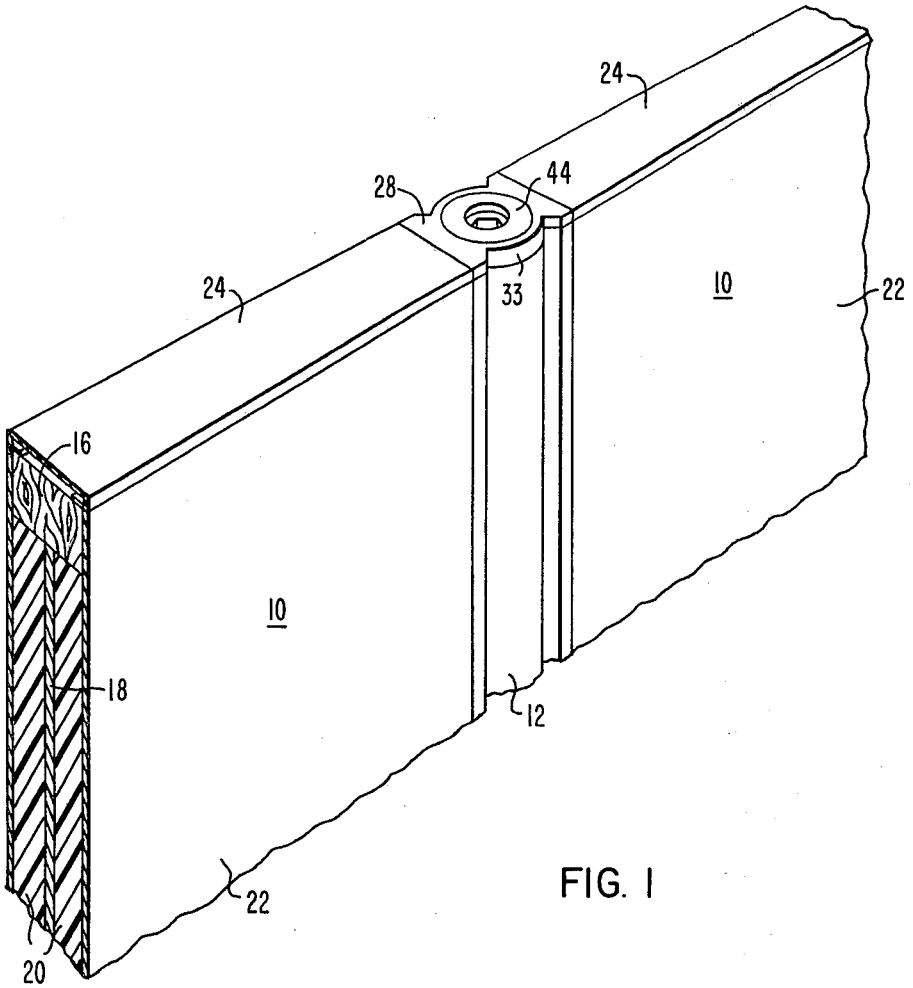
FIG. 1 is a perspective view of a rigidized wall panel system in accordance with the present invention.

Referring now in detail to the drawings wherein like reference characters represent like parts throughout the several views there is illustrated in FIG. 1 a rigidized space dividing wall panel system which includes a pair of space dividing wall panels 10 which are interconnected and supported by a cylindrical post 12. A pair of hooked connectors 14 on each side edge of the wall panels are conventionally employed to interconnect the wall panels 10 with the support post 12 in the manner disclosed in aforementioned U.S. Pat. No. 3,762,116. The bottom connectors of each pair are not shown. The wall panels 10 generally include a frame 16 which is illustrated as wood but may be aluminum or steel, an intermediate septum 18 surrounded by sound absorbing pressed fiber glass 20 and covered by either a fabric or decorative laminate outer surface 22. The space dividing wall panels further generally include a plastic top trim 24 which is releasably retained on the panel for purposes of appearance.

Figure 2:
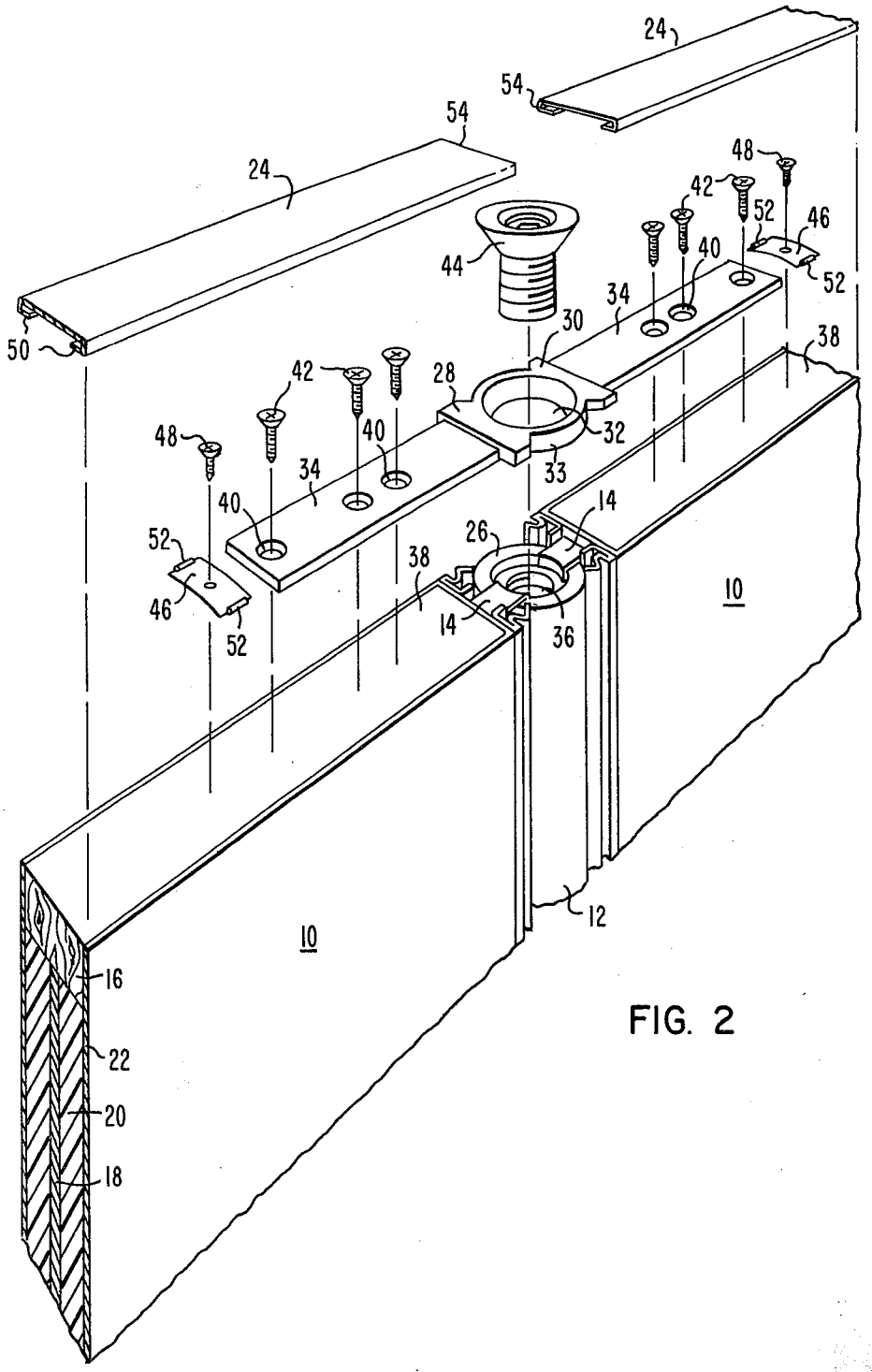
FIG. 2 is an exploded perspective view of the rigidized wall panel system of FIG. 1.
Figure 3:
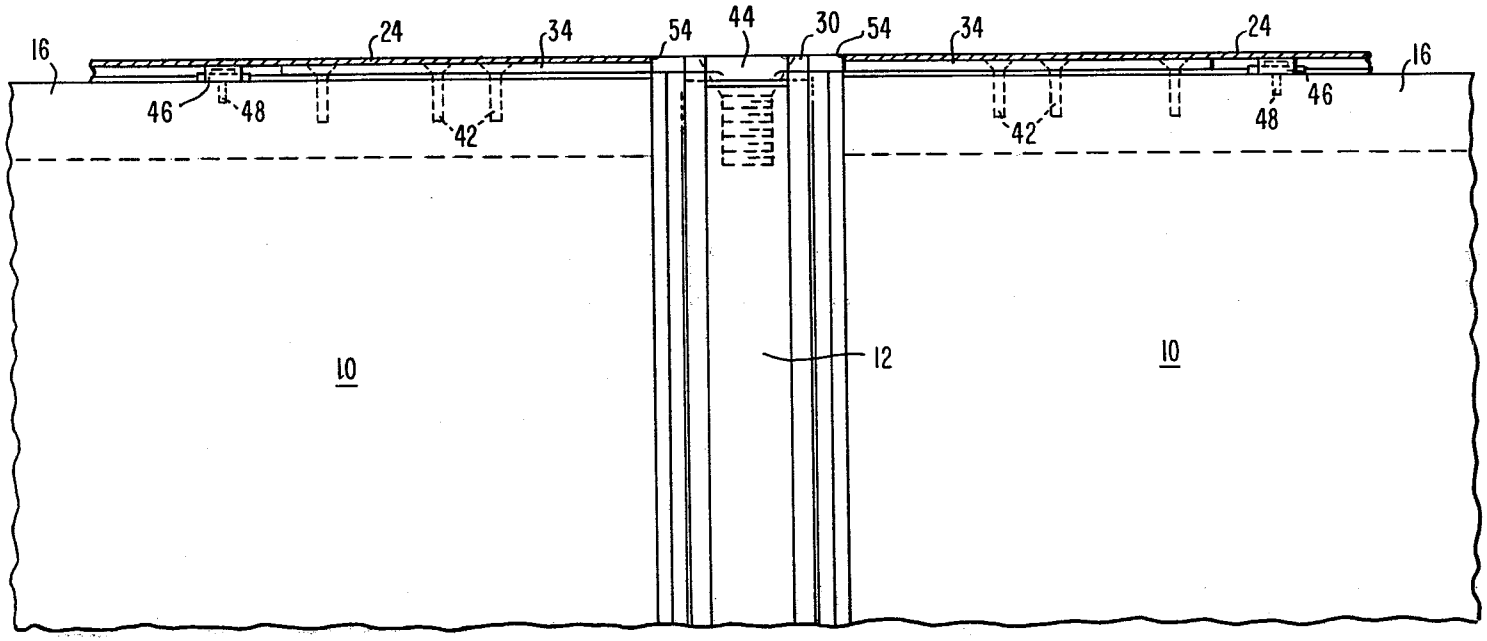
FIG. 3 is a side elevation view, partly in section, of a rigidized space dividing wall panel system.

As best seen in FIG. 2 the hooked shape connectors 14 on the side edges of the wall panels 10 interact with the upper end 26 of the tubular post 12 which is in the form of an annular ring. As will be apparent, the wall panels 10 may be disposed at any angular relationship with respect to the other. When it is desired to have a continuous linear run of a plurality of wall panels and intermediate interconnecting and supporting posts the panel rigidizer of this invention generally designated 28 may be employed.

The panel rigidizer of this invention includes a central hub portion 30 having a tapered central aperture therethrough 32 and a pair of linearly aligned elongated leg portions 34 which extend in opposite directions from the hub portion 30. The hub portion 30 is constructed and arranged to overlie a threaded central aperture 36 in the tubular support post 12 and with the elongated leg portions 34 overlying the upper surface or top edge 38 of the wall panels 10. The elongated leg portions 34 are provided with a plurality of apertures 40, preferably counter sunk through which screws 42 extend and are threadably received in the top edge 38 of the wall panels 10. A tapered post cap 44 extends through the tapered aperture 32 in the hub portion 30 of the panel rigidizer and is threadably received in the threaded aperture 36 in the tubular post 12. When the tapered post cap 44 is seated within the tapered aperture 32 the arcuate side surface 33 of the hub portion 30 gives the appearance of a conventional disc shaped post cap and the presence of the panel rigidizer is not easily discernible.

The panel rigidizer 28 is designed so that the elongated leg portions 34 are completely hidden beneath panel top trim 24 which is releasably retained on the top edge of the space dividing wall panels by a plurality of top trim retainers 46 which are mounted as by screws 48 to the top edge 38 of the panels 10. A reentrant flange 50 on each underside edge of the top trim 24 snaps over the detents 52 on the top trim retainers and the edges of the ends 54 of the top trim 24 abut the central hub portion of the panel rigidizer 28 to give a clean and neat appearance not unlike the appearance of the interconnection of space dividing wall panels and support posts where a panel rigidizer is not employed.

The panel rigidizer 28 of this invention is preferably investment cast steel with the central hub portion 30 finished with a color which is substantially identical with that of the top trim 24 and cylindrical post 12.

As will be apparent from the foregoing the panel rigidizer of this invention eliminates nonalignment of a long run of space dividing wall panels which are interconnected by cylindrical posts without detracting from the appearance of the post and panel combination and in fact provides an appearance not unlike a conventional post and panel connection.

What is claimed is:

1. A panel rigidizer for maintaining linear alignment of a plurality of space dividing wall panels comprising:

at least first and second space dividing wall panels having connector means on each end thereof;

a cylindrical post constructed and arranged to interconnect and support said first and second wall panels through said connector means, said cylindrical post having a threaded aperture in the top end thereof;

rigidizing means including a pair of linearly aligned leg portions and a hub portion therebetween, said hub portion including a tapered aperture therethrough;

means for securing one of said leg portions to the top edge of said first wall panel and the other of said leg portions to the top edge of said second wall panel whereby said tapered aperture in said hub portion overlies the threaded aperture in said cylindrical post, and post cap means having a complimentary tapered portion and a threaded portion, said post cap means extending through said tapered aperture in said hub portion of said rigidizing means whereby said complimentary tapered portion seats within said tapered aperture when the threaded portion of said post cap means is threaded into the threaded aperture in said cylindrical post.

2. The panel rigidizer according to claim 1 wherein said means for securing the leg portions to the top edge of said wall panels are screws.

3. The panel rigidizer according to claim 1 wherein top trim means is secured to the top edge of said first and second wall panels and overlies said leg portions of said rigidizing means.

* * * * *